US006402273B1

(12) United States Patent
Czesnik et al.

(10) Patent No.: US 6,402,273 B1
(45) Date of Patent: Jun. 11, 2002

(54) CABINET WITH PIVOTED FOOTREST

(75) Inventors: Marek W. Czesnik; Richard A. Fairey, both of Kitchener; Lee D. Fletcher, Waterloo, all of (CA)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/716,191

(22) Filed: Nov. 17, 2000

(51) Int. Cl.[7] ..... A47B 97/00
(52) U.S. Cl. ..... 312/235.1; 312/249.8
(58) Field of Search ..... 312/235.1, 249.8, 312/140.1, 140.2, 352

(56) References Cited

U.S. PATENT DOCUMENTS 789,800 A 5/1905 Doherty
1,839,070 A * 12/1931 Wiener
1,885,092 A * 10/1932 Fellerman
1,944,405 A * 1/1934 Copeland
2,050,848 A 8/1936 Kerckhoff
2,165,930 A 7/1939 Levine et al.
5,160,517 A * 11/1992 Hicks et al.
5,228,761 A * 7/1993 Huebschen et al.
5,450,285 A 9/1995 Schlemmer
5,755,498 A 5/1998 Cutler
6,103,985 A * 8/2000 Shell et al.

* cited by examiner

*Primary Examiner*—Janet M. Wilkens
(74) *Attorney, Agent, or Firm*—Francis L. Conte

(57) ABSTRACT

A cabinet includes a frame extending vertically upwardly from a base. Wheels are mounted to the base for moving the cabinet over a floor. And, an elongate footrest is pivotally mounted to the base at the front of the cabinet for providing posture relief for the user.

20 Claims, 6 Drawing Sheets

CABINET WITH PIVOTED FOOTREST

BACKGROUND OF THE INVENTION

The present invention relates generally to office machines and equipment, and, more specifically, to ergonomics thereof.

Many types of business equipment are configured for stand-up operation thereof by the intended user. For example, a check processing machine includes a check feeder at waist level of the user in which batches of checks are fed and transported in turn to a cooperating imager which captures the images of the checks for record keeping purposes. The user stands in front of the machine for controlling its operation, and long periods of standing subject the user to discomfort.

Accordingly, it is desired to provide an improved machine cabinet having posture relief for the user when standing for extended periods.

BRIEF SUMMARY OF THE INVENTION

A cabinet includes a frame extending vertically upwardly from a base. Wheels are mounted to the base for moving the cabinet over a floor. And, an elongate footrest is pivotally mounted to the base at the front of the cabinet for providing posture relief for the user.

BRIEF DESCRIPTION OF THE DRAWINGS

The invention, in accordance with preferred and exemplary embodiments, together with further objects and advantages thereof, is more particularly described in the following detailed description take pin conjunction with the accompanying drawings in which.

DETAILED DESCRIPTION OF THE INVENTION

Figure 1:
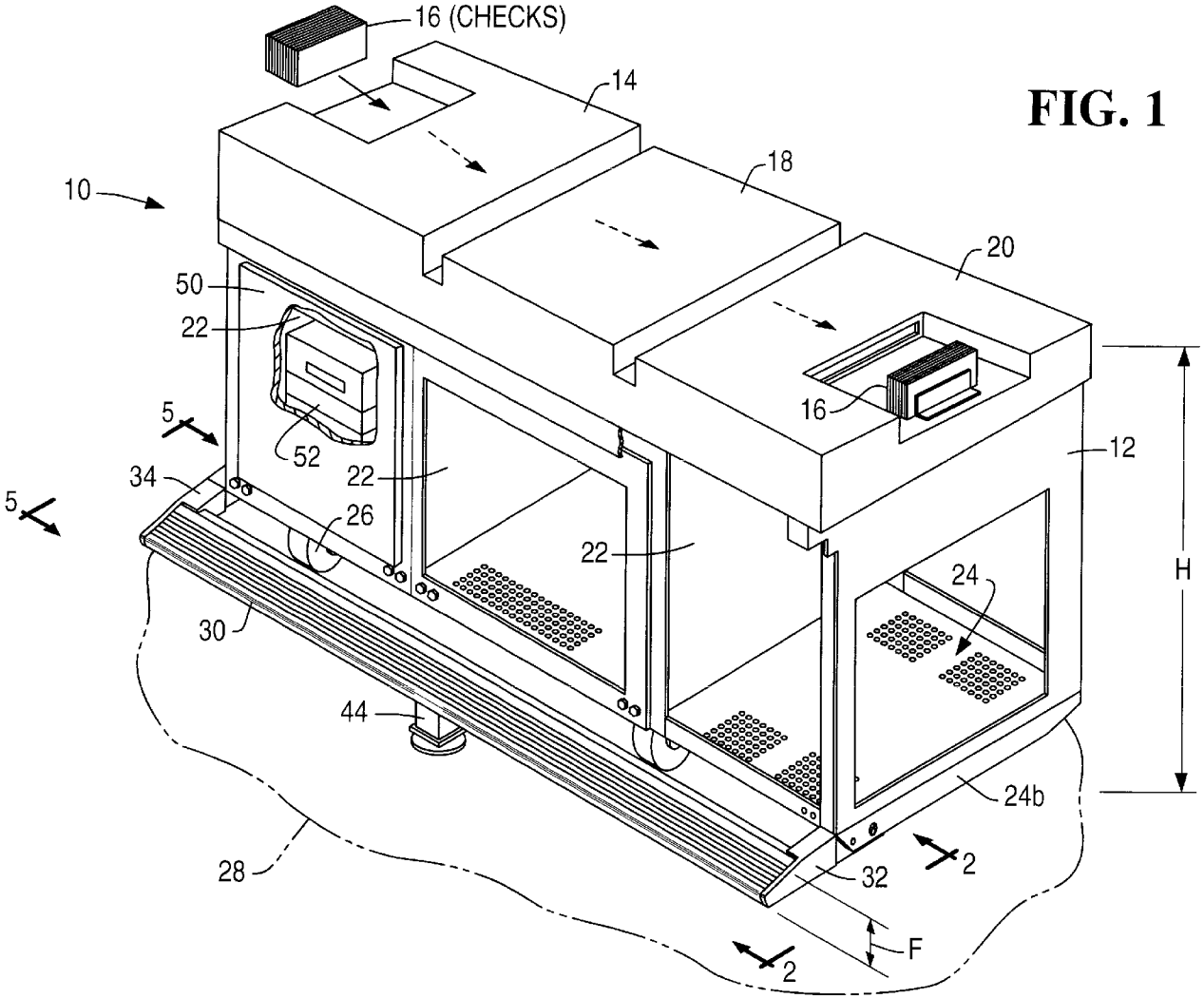
FIG. 1 is an isometric view of a machine cabinet having a footrest in accordance with an exemplary embodiment of the present invention.

Illustrated in FIG. 1 is a machine cabinet 10 configured for use in stand-up operation by a user in an exemplary embodiment. The cabinet includes a metal frame 12 which is an assembly of various walls, braces, and angle iron arranged in any suitable configuration for the particular machine desired. The machine, itself, may have any conventional configuration for performing any desired function, with the cabinet 10 being specifically configured therefor.

In the exemplary embodiment illustrated in FIG. 1, the machine cabinet 10 is configured in the form of a check processing machine including a check feeder 14 suitably mounted atop the frame for feeding a plurality of conventional checks 16 into the machine.

A stager 18 is also mounted atop the frame adjacent to the feeder for receiving and staging the checks received therefrom in turn. An electronic imager 20 is also mounted atop the frame adjacent the stager for obtaining electronic images of the checks as they are fed thereto in turn.

The feeder, stager, and imager are shown schematically and may have any conventional configuration and operated in any conventional manner for processing the checks therethrough in a conventional manner which typically requires the user to operate the machine while standing up as opposed to sitting down, although the machine could also be configured for the sitting down position if desired.

The frame 12 illustrated in FIG. 1 may have any conventional configuration for supporting the operating equipment mounted thereatop at a suitable level or height H, such as ordinary waist level of the user. The frame 12 is configured with one or more internal compartments 22, with three horizontally adjoining compartments being illustrated. The compartments are defined by corresponding portions of the frame and extend vertically upwardly from a common base 24 of the frame which is suitably rigid in construction for providing a sufficiently strong platform upon which the several components of the machine cabinet may be carried.

A plurality of wheels 26 are suitably mounted to the bottom of the base at four corresponding corner positions for moving the cabinet over a floor 28 when pushed by one or more users.

In accordance with the present invention, an elongate footrest 30 is mounted at opposite axial or horizontal ends thereof in a pair of end caps 32,34 which are pivotally joined to the base 24 at the bottom front of the cabinet.

Figure 2:
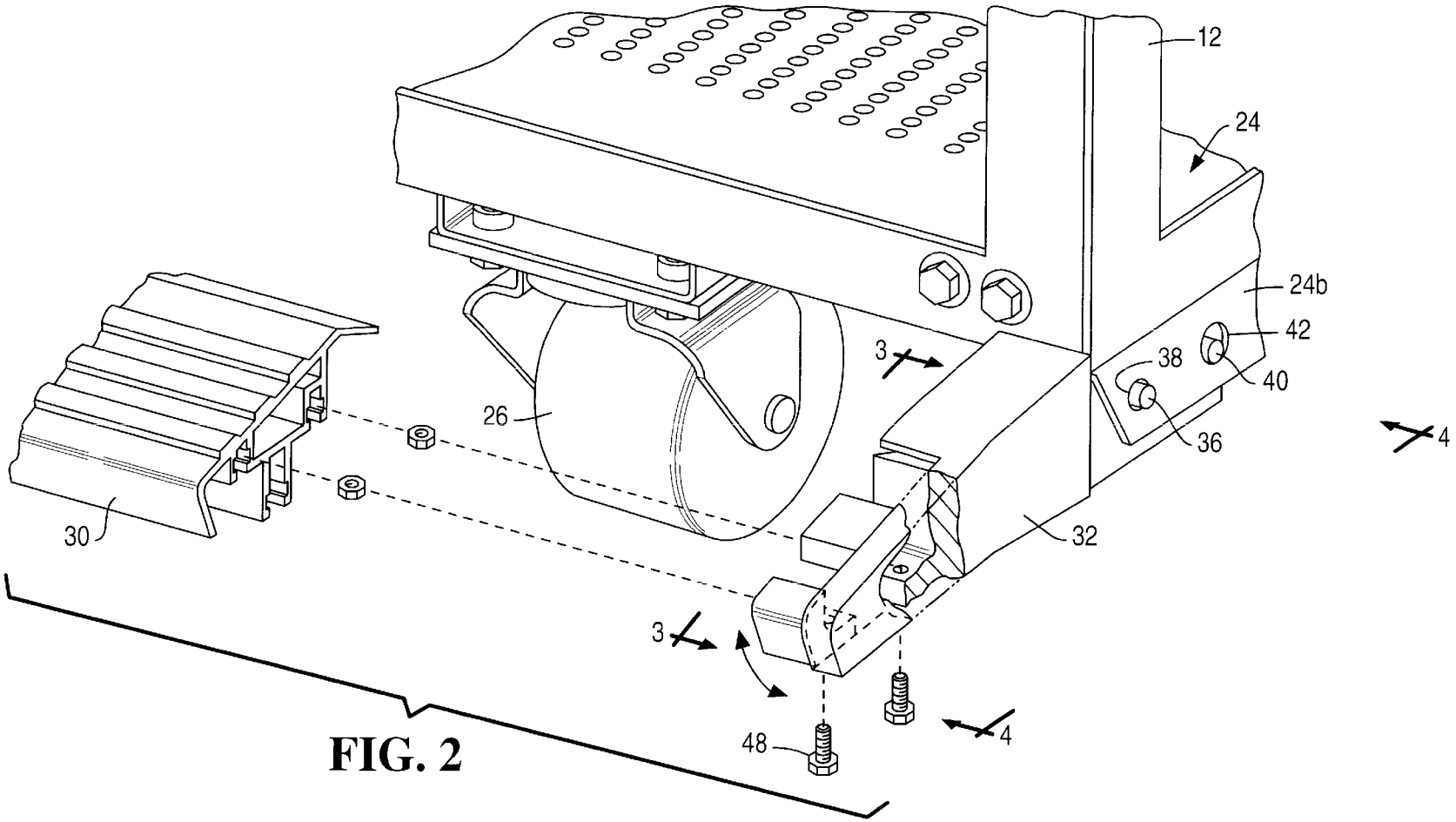
FIG. 2 is an enlarged, exploded view of the right end cap supporting the footrest at the lower front side of the cabinet illustrated in FIG. 1 and taken along line 2—2.

As illustrated in more detail in FIG. 2, each of the end caps 32,34 is mounted to the base 24 by a first pin 36 pivotally supported inside a complementary first aperture 38, and a second pin 40 spaced horizontally from the first pin and pivotally supported inside a second aperture 42 which is larger in diameter than that of the second pin to provide a predetermined radial gap or clearance therebetween for permitting pivotal vertical movement of the footrest 30 on the base.

As illustrated in FIG. 1, the frame 12 is preferably sized in height H to position the feeder, stager, and imager at waist level for a standing person or user. And, the footrest 30 is mounted to the base at a suitable height F from the floor for supporting one of the user's feet, while standing, at an ergonomically comfortable position above the floor. For example, the elevational position of the footrest may be about 4 to 6 inches above the floor for raising the user's foot to that level while the other foot remains on the floor. In this way, the user is provided with posture relief for reducing discomfort during standing over extended periods when operating the machine.

The footrest 30 preferably extends over the entire horizontal length of the base of the cabinet which may be about 4 to 5 feet, for example. Since the footrest is supported at its opposite ends by the corresponding end caps 32,34, the footrest itself is preferably relatively rigid with a suitably high bending movement of inertia. This may be effected by manufacturing the footrest in a metal extrusion, of aluminum for example, having thin walls and thin stiffening ribs extending the full length of the footrest. The footrest is relatively hollow, lightweight, yet rigid, and includes on its upper surface longitudinally extending cleats if desired for frictionally retaining the user's foot thereon.

Since the footrest is supported at its opposite ends and has a considerable length, a user may elastically deform the footrest by standing on the middle thereof and applying excessive force. This force, in turn, is carried through the two end pin pairs 36,40 into the frame base 24.

Accordingly, the footrest preferably includes a vertical brace or post 44 as shown in FIG. 1 fixedly mounted preferably in the middle of the bottom surface thereof between the opposite ends.

The post 44 is preferably suspended vertically below the footrest with a suitable height to reach the bottom plane of the wheels 26 defined atop the floor 28. The bottom of the post 44 may include any conventional metal or plastic glider to engage the top of the floor and provide a direct loadpath from the footrest to the floor through which foot loads atop the footrest are directly carried to the floor without undesirably deforming or overloading the footrest during use, or overloading the mounting pins 36,40.

Since the post 44 may contact the floor during normal operation of the cabinet, or may be spaced therefrom with a small clearance, the pivotal mounting of the footrest permits the footrest to be pivoted upwardly as the cabinet is pushed and rolled over the floor for preventing obstruction of the post with the floor or uneven portions thereof.

As illustrated in FIG. 2, the base 24 preferably includes a pair of horizontally spaced apart end flanges 24*b* at opposite ends thereof, which may be in the form of typical angle iron. Each end of flange 24*b* includes a respective pair of the first and second apertures 38,42 extending horizontally therethrough. And, a respective pair of the first and second pins 36,40 extend from each of the end caps into the end flanges in the preferred embodiment illustrated. In an alternate embodiment not illustrated, the apertures may be formed in the end caps, with the pins extending from the end flanges.

FIG. 2 illustrates a preferred form of the first or right end cap 32 in which the respective first and second pins 36,40 are fixedly joined thereto either in an integral or unitary configuration, or by being press fit into corresponding mounting bores therein.

Figure 3:
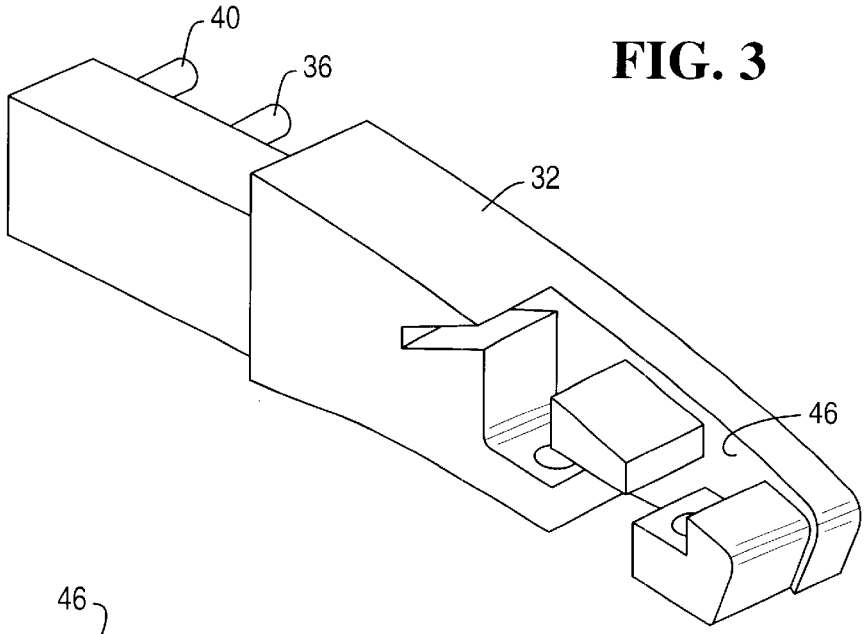
FIG. 3 is an isometric view of the right end cap illustrated in FIG. 2 in isolation.

FIG. 3 illustrates the right end cap 32 in isolation, with the pins 36,40 extending perpendicularly outwardly from the right side thereof.

Figure 4:
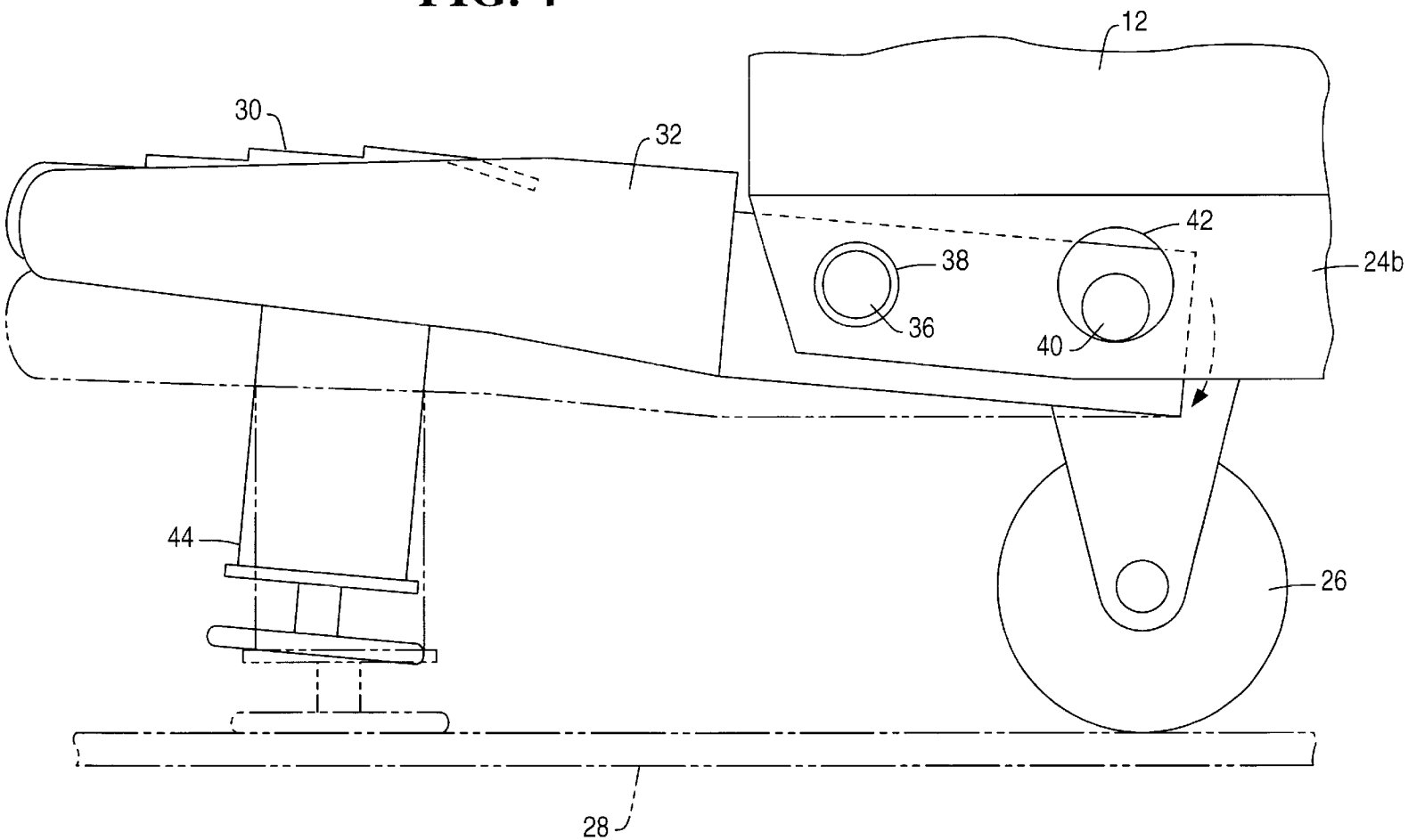
FIG. 4 is a side elevational view of the right end cap illustrated in FIG. 2 and taken along line 3–3.

FIG. 4 illustrates the right end cap 32 in solid line pivoted in its up-position, and in phantom line pivoted to its down-position.

Figure 5:
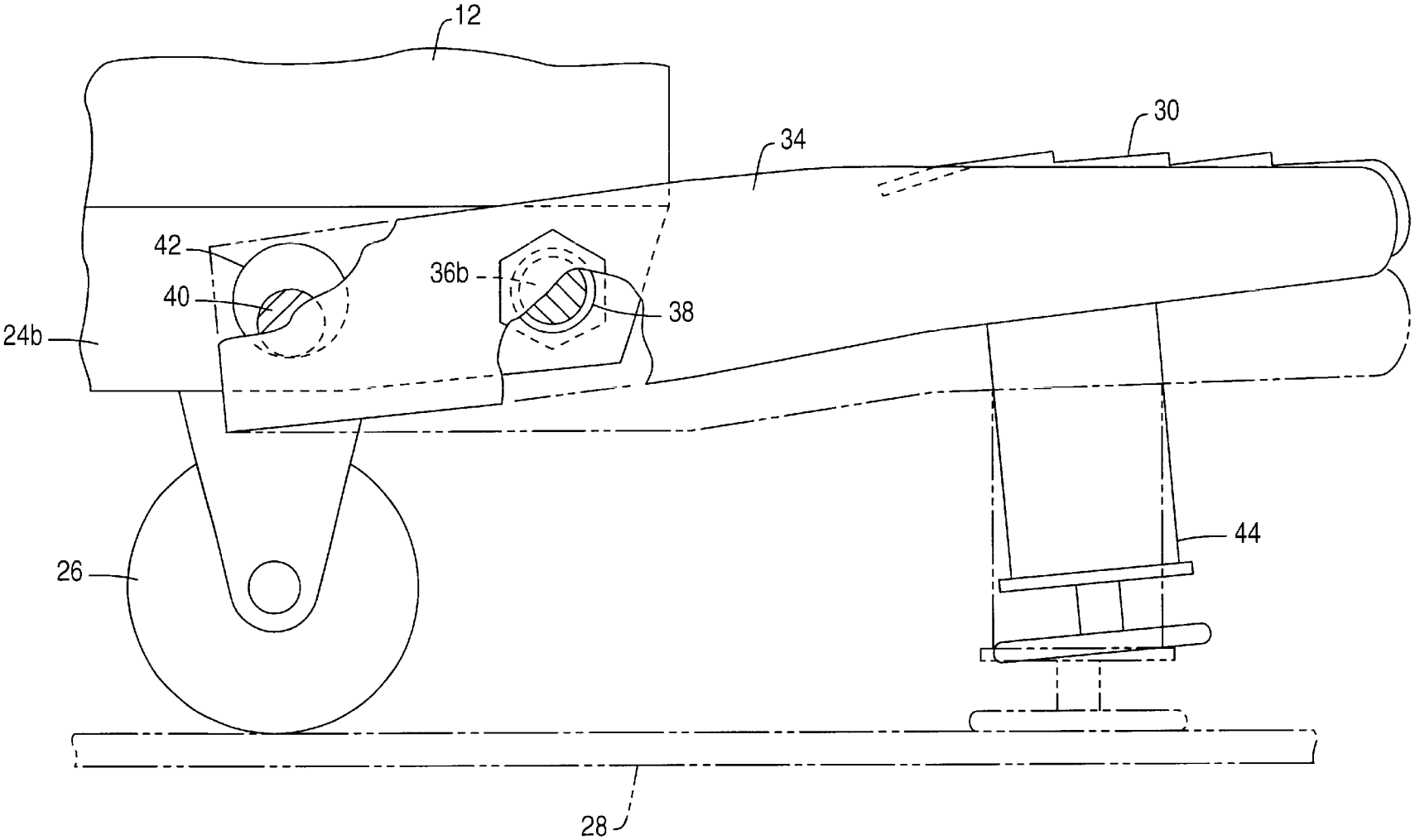
FIG. 5 is a side elevational view of the left end cap supporting the footrest at the bottom left front of the cabinet illustrated in FIG. 1 and taken along 5—5.

FIG. 5 illustrates the corresponding second or left end cap 34 in solid line in its up-position, and in phantom line in its down-position.

Figure 7:
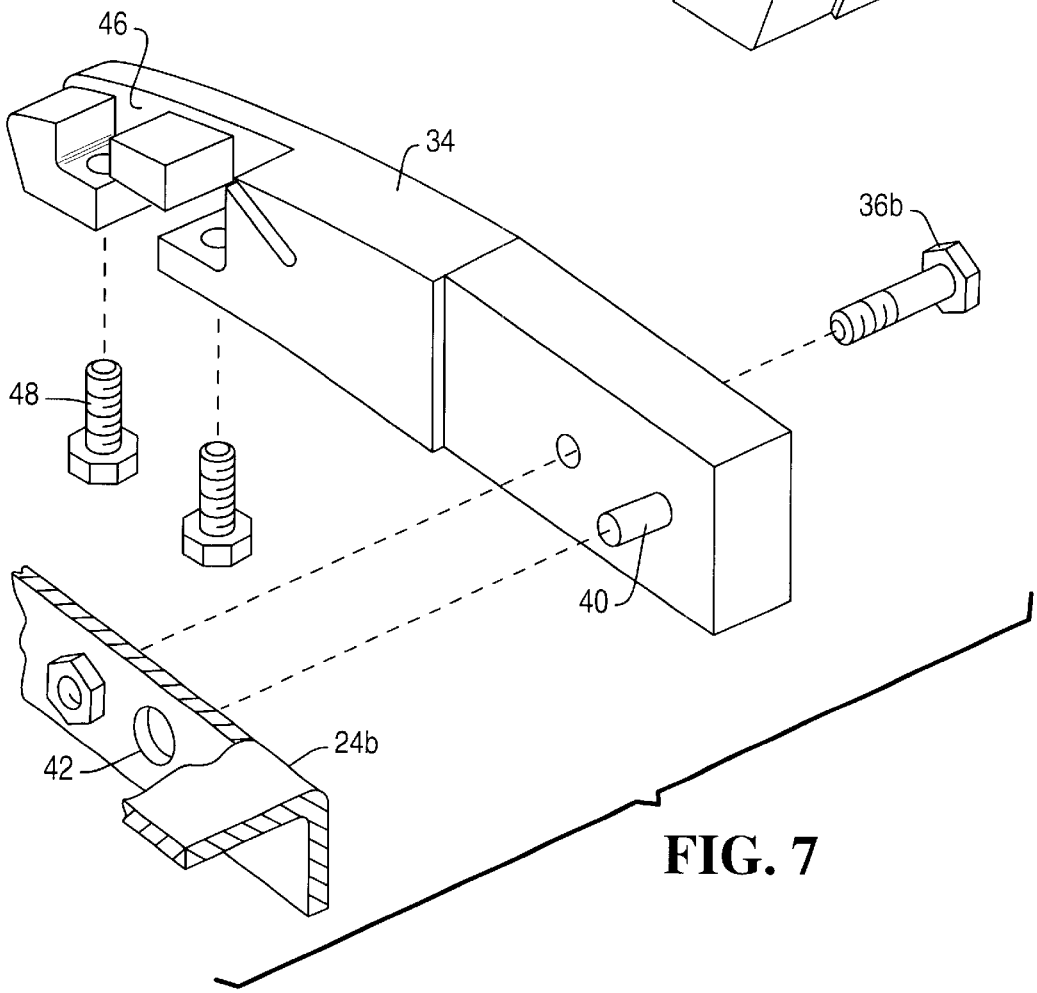
FIG. 7 is an exploded view of the left end cap in a preferred embodiment for being mounted to a portion of the base illustrated in FIG. 6 and taken along 7—7.
Figure 6:
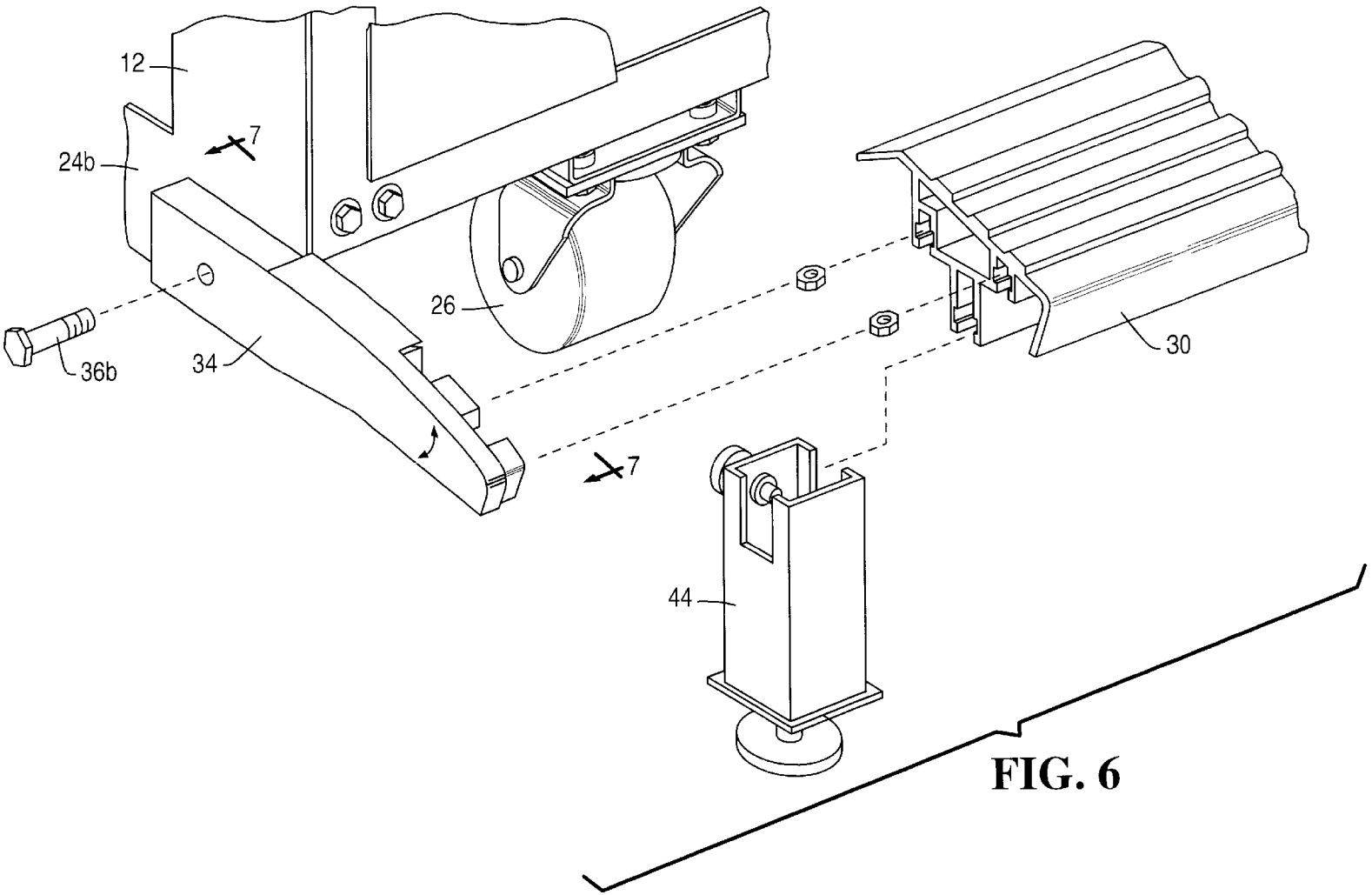
FIG. 6 is an enlarged, exploded view of the left end cap for supporting the footrest illustrated in FIG. 1.

FIG. 6 illustrates the left end cap 32, footrest 30, and supporting post 44 in exploded view. And, FIG. 7 illustrates the left end cap 34 in exploded view with a portion of the base flange 24*b* to which it is mounted.

As initially shown in FIG. 5, the second end cap 34 is configured in generally a mirror image to the first end cap 32 illustrated in FIG. 4, but includes a respective first pin in the form of a threaded bolt 36*b* pivotally mounted through an aperture in the end cap, and the respective second pin 40 is fixedly joined to the second end cap in preferably the same manner as the corresponding second pin in the first end cap.

Whereas the first and second end caps 32,34 illustrated in FIGS. 2 and 6 are similarly configured for being mounted to the opposite longitudinal ends of the footrest 30 and pivotally mounted to the base frame, the pin arrangement thereof is preferably different. In FIG. 2, the right end cap 32 adjoins the corresponding lower right base flange 24*b* internally between the opposite two flanges 24*b*, with the two pins 36,40 facing outwardly or externally through the flange apertures 38,42.

As shown in FIG. 6, the left end cap 34 adjoins the bottom left base flange 24*b* externally thereof, with the pins 36*b*,40 extending inwardly through the corresponding apertures in the base flange.

This configuration of the pin mounted end caps permits simple assembly of the several components of the supported footrest in an efficient manner. More specifically, as shown in FIGS. 3 and 7, each of the end caps 32,34 is an elongate member which may be manufactured from a suitable metal, such as aluminum, in a cast or machined part. Each end cap is similarly configured with a supporting beam or shank defining its proximal end extending integrally with a slotted or recessed seat 46 defining the distal end thereof The respective pins are mounted in the shank, and the opposite ends of the footrest 30 are mounted in the respective seats 46 which have a complementary configuration for providing a snug fit therewith. As shown in FIGS. 2 and 6, suitable fasteners 48, in the form of threaded bolts and nuts, are used to fixedly join the corresponding ends of the footrest into their respective mounting seats 46 in any suitable manner.

Accordingly, the footrest 30 illustrated in FIGS. 2 and 6 may be initially mated with the corresponding seats of the respective two end caps 32,34 and fixedly joined thereto by the fasteners 48. This three-part assembly of the footrest and end caps may then be assembled to the corresponding base flanges 24*b* by firstly inserting the two right pins 36,40 through the corresponding apertures 38,42 of the right flange shown in FIG. 2 while at the same time, the second pin 40 of the left flange 34 illustrated in FIG. 7 is inserted into its mating aperture 42 in the bottom left flange.

The corresponding bolt pin 36*b* is then inserted through the left end cap as illustrated in FIGS. 6 and 7 to threadingly engage a cooperating retention nut illustrated in FIG. 7 mounted inside the left flange 24*b*. The single threaded pin 36*b* traps the left end cap 34 on the outboard side of the left base flange 24*b* illustrated in FIG. 6, and correspondingly also traps the right end cap 32 illustrated in FIG. 2 on the inboard side of the right base flange 24*b*.

The supporting post 44 is illustrated in FIG. 6 in accordance with an exemplary embodiment and has a mounting slot configured to engage a downwardly facing, longitudinal rail integrally formed in the bottom of the footrest. The supporting post 44 includes a fastening bolt which may be tightened for trapping the post 44 on its mounting rail at any convenient position along the longitudinal length of the footrest. In the preferred embodiment illustrated in FIG. 1, the supporting post 44 is mounted at the middle of the footrest for distributing the foot loads applied to the footrest between the two opposite end caps and the supporting post 44 itself.

The first pin 36 illustrated in FIG. 4 has a diameter slightly less than the diameter of its supporting first aperture 38 for permitting pivotal movement therebetween. And, the left end cap 34 illustrated in FIG. 5 includes the bolt pin 36*b* having a diameter slightly less than that of the first aperture 38 for similarly permitting pivoting of the end cap therebetween.

As illustrated in FIG. 4, the clearance gap between the second pin 40 and its surrounding aperture 42 is sized to permit predetermined pivoting of the footrest 30 upwardly to space the post 44 above the floor 28 for permitting unrestrained rolling of the cabinet over the floor. In this way, when the floor is covered with a soft carpet, or has uneven surfaces, the footrest may be slightly elevated to clear the supporting post 44 from the floor to permit rolling of the cabinet without the post 44 dragging on the floor.

The left end cap 34 illustrated in FIG. 5 is similarly configured with the respective second pin 40 thereof being mounted in the corresponding second aperture 42 with a clearance gap preferably identical to that provided in the right end cap 32 illustrated in FIG. 4.

The gaps around the left and right pins 40 are preferably sized to allow the footrest to pivot vertically at its front edge any suitable amount, such as about 0.5 to 2 inches. In this way, the foot rest may be lowered so the post 44 contacts the floor or is spaced closely thereatop. Foot loads are then carried by the first pins 36,36*b* and the floor-contacting post 44, or by the first and second pins alone without the post contacting the floor. And, the foot rest may be raised to clear the bottom of the post 44 from the floor.

As illustrated in FIG. 1, any one or more of the cabinet compartments 22 may have a door 50 on the front side thereof, or access panels which may be removably mounted thereto. Disposed inside the left compartment is a digitally programmable computer 52 which controls operation of the check processing machine. Disposed inside the middle and right compartments are various electronic components such as integrated circuit boards (not shown) which are also used in controlling operation of the check processing machine. The panels or doors covering the front of these compartments must be readily opened for servicing the various operating components of the machine stored in the compartments.

An additional advantage of pivoting the footrest is that it may be pivotable downwardly with its supporting end caps 32,34 in order to clear the bottom portion of the door for permitting opening thereof without obstruction from the footrest itself. It is desired to mount the footrest at a sufficient height F for providing posture relief to the user or attendant, yet that height may position the footrest to block the door from opening.

Accordingly, the clearances provided between the second pins and apertures 40,42 may be selected for pivoting upwardly the footrest for clearing the floor and permitting rolling of the cabinet, yet the footrest may also be pivoted downwardly for clearing the door 50 for permitting unobstructed opening thereof. The pivoting clearance may be sufficient for dropping the footrest until the supporting post 44 contacts the floor, or the supporting post 44 may be temporarily removed from the footrest, with the provided clearance between the pins and apertures permitting a greater amount of lowering of the footrest for clearing the cabinet door.

Accordingly, any machine cabinet may be provided with the pivotable footrest 30 illustrated in FIG. 1 for providing a raised land upon which a user may temporarily position a foot for posture relief and improving comfort while standing in attendance in operating the machine. The few parts of the footrest and its mounting end caps permit ready assembly of the footrest to the cabinet with the need solely for the cooperating apertures in the base flanges thereof. The footrest is readily pivotable upwardly or downwardly as desired for permitting unrestrained rolling of the cabinet while also permitting access without obstruction to the cabinet doors.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured letters patent of the united states is the invention as defined and differentiated in the following claims in which we claim:

What is claimed is:

1. A cabinet comprising:

a frame including an internal compartment extending vertically upwardly from a base;

a plurality of wheels mounted to said base for moving said cabinet over a floor;

an elongate footrest mounted at opposite ends in a pair of end caps pivotally joined to said base at a front of said cabinet; and wherein each of said end caps is mounted to said base by a first pin pivotally supported inside a complementary first aperture, and a second pin spaced from said first pin and pivotally supported inside a second aperture being larger than said second pin to provide a gap therebetween for permitting pivotable movement of said footrest on said base.

2. A cabinet according to claim 1 wherein said base includes a pair of spaced apart end flanges each including a respective pair of said first and second apertures therein, and a respective pair of said first and second pins extend from each of said end caps into said end flanges.

3. A cabinet according to claim 2 wherein a first one of said end caps includes said respective first and second pins fixedly joined thereto; and a second one of said end caps includes a respective first pin pivotally mounted therethrough, and said respective second pin is fixedly joined thereto.

4. A cabinet according to claim 3 wherein each of said end caps comprises a supporting shank including said pins, and an integral slotted seat in which said opposite ends of said footrest are fixedly mounted.

5. A cabinet according to claim 3 wherein said footrest includes a vertical post fixedly mounted between said opposite ends thereof.

6. A cabinet according to claim 5 wherein said post is suspended from said footrest vertically in height to reach the bottom plane of said wheels.

7. A cabinet according to claim 6 wherein said gap between said second pin and aperture is sized to permit pivoting of said footrest upwardly to space said post from said floor and permit unrestrained rolling of said cabinet over said floor.

8. A cabinet according to claim 3 wherein:

said first end cap adjoins a first one of said flanges internally between said flanges; and said second end cap adjoins a second one of said flanges externally thereof.

9. A cabinet according to claim 3 wherein:

said compartment has a door; and said footrest is pivotable downwardly with said end caps to clear said door and permit unobstructed opening thereof.

10. A cabinet according to claim 3 further comprising:

a feeder mounted atop said frame for feeding a plurality of checks;

a stager mounted atop said frame adjacent said feeder for receiving and staging said checks in turn; and an imager mounted atop said frame adjacent said stager for obtaining images of said checks fed thereto in turn.

11. A cabinet according to claim 10 wherein said frame is sized in height to position said feeder, stager, and imager at waist level for a standing user, with said footrest being positioned in height for supporting the user's foot, while standing, at a comfortable position above said floor.

12. A cabinet comprising:

a frame including an internal compartment extending vertically upwardly from a base;

said base includes first and second spaced apart end flanges;

a plurality of wheels mounted to said base for moving said cabinet over a floor;

an elongate footrest mounted at opposite ends in first and second end caps pivotally joined to said first and second flanges, respectively, at a front of said cabinet;

said first end cap adjoins said first flange internally between said flanges; and said second end cap adjoins said second flange externally thereof.

13. A cabinet according to claim 12 wherein:

each of said flanges includes a respective pair of first and second apertures therein; and said first and second end caps are respectively mounted to said first and second flanges by a corresponding first pin pivotally supported inside said first aperture, and a corresponding second pin spaced from said first pin and pivotally supported inside said second aperture being larger than said second pin to provide a gap therebetween for permitting pivotable movement of said footrest on said base.

14. A cabinet according to claim 13 wherein said footrest includes a vertical post fixedly mounted between said opposite ends thereof.

15. A cabinet according to claim 14 wherein each of said end caps comprises a supporting shank including said pins, and an integral slotted seat in which said opposite ends of said footrest are fixedly mounted.

16. A cabinet according to claim 15 wherein said first end cap includes said respective first and second pins fixedly joined thereto; and said second end cap includes said respective first pin pivotally mounted therethrough, and said respective second pin fixedly joined thereto.

17. A cabinet comprising:

a frame including an internal compartment extending vertically upwardly from a base, said compartment having a door;

a feeder mounted atop said frame for feeding a plurality of checks;

a stager mounted atop said frame adjacent said feeder for receiving and staging said checks in turn;

an imager mounted atop said frame adjacent said stager for obtaining images of said checks fed thereto in turn;

a plurality of wheels mounted to said base for moving said cabinet over a floor;

an elongate footrest mounted at opposite ends in a pair of end caps pivotally joined to said base at a front of said cabinet;

each of said end caps being mounted to said base by a first pin pivotally supported inside a complementary first aperture, and a second pin spaced from said first pin and pivotally supported inside a second aperture being larger than said second pin to provide a gap therebetween for permitting pivotable movement of said footrest on said base; and said footrest being pivotable downwardly with said end caps to clear said door and permit unobstructed opening thereof.

18. A cabinet according to claim 17 wherein said base includes a pair of spaced apart end flanges each including a respective pair of said first and second apertures therein, and a respective pair of said first and second pins extend from each of said end caps into said end flanges.

19. A cabinet according to claim 18 wherein a first one of said end caps includes said respective first and second pins fixedly joined thereto; and a second one of said end caps includes a respective first pin pivotally mounted therethrough, and said respective second pin is fixedly joined thereto.

20. A cabinet according to claim 19 wherein:

each of said end caps comprises a supporting shank including said pins, and an integral slotted seat in which said opposite ends of said footrest are fixedly mounted; and said footrest includes a vertical post fixedly mounted between said opposite ends thereof.

* * * * *